US009207624B2

(12) United States Patent
Toyama et al.

(10) Patent No.: US 9,207,624 B2
(45) Date of Patent: Dec. 8, 2015

(54) CLEANING BLADE, METHOD FOR PREPARING THE CLEANING BLADE, AND IMAGE FORMING APPARATUS AND PROCESS CARTRIDGE USING THE CLEANING BLADE

(71) Applicants: Kaori Toyama, Kanagawa (JP); Shinji Nohsho, Tokyo (JP); Masanobu Gondoh, Kanagawa (JP); Shohei Gohda, Kanagawa (JP); Yohta Sakon, Kanagawa (JP); Masahiro Ohmori, Kanagawa (JP); Hiromi Sakaguchi, Kanagawa (JP)

(72) Inventors: Kaori Toyama, Kanagawa (JP); Shinji Nohsho, Tokyo (JP); Masanobu Gondoh, Kanagawa (JP); Shohei Gohda, Kanagawa (JP); Yohta Sakon, Kanagawa (JP); Masahiro Ohmori, Kanagawa (JP); Hiromi Sakaguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/597,356

(22) Filed: Jan. 15, 2015

(65) Prior Publication Data

US 2015/0212479 A1 Jul. 30, 2015

(30) Foreign Application Priority Data

Jan. 27, 2014 (JP) ..... 2014-012056

(51) Int. Cl.
*G03G 21/00* (2006.01)
*B05D 3/06* (2006.01)

(52) U.S. Cl.
CPC ..... *G03G 21/0017* (2013.01); *B05D 3/067* (2013.01)

(58) Field of Classification Search
CPC ..... G03G 21/0011; G03G 21/0017
USPC ..... 399/350
See application file for complete search history.

(56) References Cited

U.S. PATENT DOCUMENTS

| | | | |
|---|---|---|---|
| 4,957,839 | A | 9/1990 | Rokutanzono et al. |
| 5,008,172 | A | 4/1991 | Rokutanzono et al. |
| 5,147,751 | A | 9/1992 | Kojima et al. |
| 5,342,718 | A | 8/1994 | Nousho et al. |
| 5,991,573 | A | 11/1999 | Nohsho et al. |
| 6,030,733 | A | 2/2000 | Kami et al. |
| 6,060,205 | A | 5/2000 | Takeichi et al. |
| 6,151,468 | A | 11/2000 | Kami et al. |
| 6,160,977 | A | 12/2000 | Takeichi et al. |
| 6,363,237 | B1 | 3/2002 | Nagame et al. |
| 6,521,386 | B1 | 2/2003 | Sakon et al. |

(Continued)

FOREIGN PATENT DOCUMENTS

| | | |
|---|---|---|
| JP | 5-072957 | 3/1993 |
| JP | 2007-148036 | 6/2007 |
| JP | 2013-076970 | 4/2013 |

OTHER PUBLICATIONS

U.S. Appl. No. 14/284,846, filed May 22, 2014.

(Continued)

*Primary Examiner* — William J Royer
(74) *Attorney, Agent, or Firm* — Cooper & Dunham LLP

(57) ABSTRACT

A cleaning blade is provided. The cleaning blade includes a strip-shaped elastic blade. At least the tip edge portion of the elastic blade, which is to be contacted with the surface of a moving object to remove a powdery material from the surface of the moving object, includes an ultraviolet crosslinked resin, which includes an acrylate or methacrylate unit including a fluorine-containing group, and another acrylate or methacrylate unit having a tricyclodecane or adamantane skeleton, from the surface of the tip edge portion to a depth of not less than 5 μm.

8 Claims, 6 Drawing Sheets

(56) References Cited

U.S. PATENT DOCUMENTS

| | | | | |
|---|---|---|---|---|
| 6,562,529 | B1 | 5/2003 | Kojima et al. | |
| 8,644,753 | B2 * | 2/2014 | Ohmori et al. | 399/350 |
| 8,897,690 | B2 * | 11/2014 | Sakon et al. | 399/350 |
| 9,037,067 | B2 * | 5/2015 | Ikuno et al. | 399/350 |
| 2001/0031411 | A1 | 10/2001 | Kojima et al. | |
| 2002/0051654 | A1 | 5/2002 | Niimi et al. | |
| 2002/0115005 | A1 | 8/2002 | Ikuno et al. | |
| 2002/0197549 | A1 | 12/2002 | Sakon et al. | |
| 2003/0035661 | A1 | 2/2003 | Kabata et al. | |
| 2003/0049555 | A1 | 3/2003 | Sakon et al. | |
| 2003/0152854 | A1 | 8/2003 | Kojima et al. | |
| 2003/0165757 | A1 | 9/2003 | Kojima et al. | |
| 2003/0219279 | A1 | 11/2003 | Nohsho et al. | |
| 2004/0048178 | A1 | 3/2004 | Ikuno et al. | |
| 2004/0058260 | A1 | 3/2004 | Katoh et al. | |
| 2005/0026058 | A1 | 2/2005 | Kami et al. | |
| 2005/0031377 | A1 | 2/2005 | Kabata et al. | |
| 2005/0053853 | A1 | 3/2005 | Sugino et al. | |
| 2005/0118518 | A1 | 6/2005 | Ikegami et al. | |
| 2005/0238977 | A1 | 10/2005 | Kojima et al. | |
| 2006/0062595 | A1 | 3/2006 | Nousho et al. | |
| 2006/0210908 | A1 | 9/2006 | Umemura et al. | |
| 2006/0269323 | A1 | 11/2006 | Kabata et al. | |
| 2007/0287083 | A1 | 12/2007 | Gondoh et al. | |
| 2008/0063962 | A1 | 3/2008 | Toshine et al. | |
| 2008/0102391 | A1 | 5/2008 | Yanagawa et al. | |
| 2008/0112742 | A1 | 5/2008 | Nakamori et al. | |
| 2008/0113285 | A1 | 5/2008 | Nakamori et al. | |
| 2008/0219694 | A1 | 9/2008 | Nakamori et al. | |
| 2008/0227007 | A1 | 9/2008 | Tamoto et al. | |
| 2009/0035017 | A1 | 2/2009 | Tada et al. | |
| 2009/0148186 | A1 | 6/2009 | Yasuda et al. | |
| 2009/0180788 | A1 | 7/2009 | Tamoto et al. | |
| 2009/0185821 | A1 | 7/2009 | Iwamoto et al. | |
| 2009/0311017 | A1 | 12/2009 | Ohmori et al. | |
| 2009/0324281 | A1 | 12/2009 | Tada et al. | |
| 2010/0010204 | A1 | 1/2010 | Ohta et al. | |
| 2010/0067953 | A1 | 3/2010 | Nohsho et al. | |
| 2010/0129112 | A1 | 5/2010 | Tada et al. | |
| 2010/0232831 | A1 | 9/2010 | Fujiwara et al. | |
| 2010/0310975 | A1 | 12/2010 | Tada et al. | |
| 2010/0329741 | A1 | 12/2010 | Nohsho et al. | |
| 2011/0135361 | A1 | 6/2011 | Kabata et al. | |
| 2011/0159418 | A1 | 6/2011 | Sakaguchi et al. | |
| 2011/0159420 | A1 | 6/2011 | Sakaguchi et al. | |
| 2011/0200926 | A1 | 8/2011 | Tanaka et al. | |
| 2011/0217102 | A1 | 9/2011 | Ohmori et al. | |
| 2012/0021346 | A1 | 1/2012 | Nagayama et al. | |
| 2012/0063816 | A1 | 3/2012 | Yamashita et al. | |
| 2012/0063826 | A1 | 3/2012 | Ohmori et al. | |
| 2013/0064578 | A1 | 3/2013 | Yamashita et al. | |
| 2013/0189012 | A1 | 7/2013 | Sakon et al. | |
| 2013/0243506 | A1 | 9/2013 | Ikuno et al. | |
| 2013/0243507 | A1 | 9/2013 | Sakon et al. | |
| 2014/0064810 | A1 | 3/2014 | Iwamoto et al. | |
| 2014/0178103 | A1 | 6/2014 | Gohda et al. | |
| 2014/0205338 | A1 | 7/2014 | Gondoh et al. | |
| 2014/0270876 | A1 | 9/2014 | Yamashita et al. | |

OTHER PUBLICATIONS

U.S. Appl. No. 14/323,018, filed Jul. 3, 2014.

* cited by examiner

PROJECTED IMAGE OF PARTICLE

PERIMETER: C1

AREA: S

CIRCLE WITH AREA OF S

PERIMETER: C2

AREA: S

CLEANING BLADE, METHOD FOR PREPARING THE CLEANING BLADE, AND IMAGE FORMING APPARATUS AND PROCESS CARTRIDGE USING THE CLEANING BLADE

CROSS-REFERENCE TO RELATED APPLICATIONS

This patent application is based on and claims priority pursuant to 35 U.S.C. §119 to Japanese Patent Application No. 2014-012056 filed on Jan. 27, 2014 in the Japan Patent Office, the entire disclosure of which is hereby incorporated by reference herein.

BACKGROUND

1. Technical Field

This disclosure relates to a cleaning blade, and to an image forming apparatus and a process cartridge, which use the cleaning blade. In addition, this disclosure relates to a method for preparing the cleaning blade.

2. Description of the Related Art

In electrophotographic image forming apparatuses, residual toner remaining on the surface of an image bearer such as photoreceptors even after a toner image thereon is transferred onto a recording medium or an intermediate transfer medium is removed therefrom using a cleaner.

A strip-shaped cleaning blade made of an elastic material such as polyurethane rubbers is typically used as a cleaning member of such a cleaner because of having advantages such that the cleaner has simple structure and good cleanability. The cleaning blade typically has a configuration such that one end thereof is supported by a supporter, and an edge of the other end is contacted with a surface of an image bearer to block and scrape off residual toner on the surface of the image bearer, thereby removing the residual toner from the surface of the image bearer.

In attempting to fulfill a recent need for high quality images, there are image forming apparatuses using substantially spherical toner (hereinafter sometimes referred to as polymerization toner), which has a relatively small particle diameter and which is prepared by a method such as polymerization methods. Since polymerization toner has such an advantage as to have a higher transfer efficiency than pulverization toner, which has been conventionally used, the polymerization toner can fulfill the need. However, polymerization toner has such a drawback as not to be easily removed from an image bearer by a cleaning blade, resulting in occurrence of a cleaning problem. This is because such polymerization toner has a high circularity and a small particle diameter, and therefore easily passes through a small gap between the tip of a cleaning blade and the surface of an image bearer.

In attempting to prevent occurrence of such a cleaning problem (i.e., toner passing problem), a technique such that the pressure to a cleaning blade contacted with the surface of an image bearer is increased is often used to enhance the cleanability of the cleaning blade. However, it is well known that when the contact pressure of such a cleaning blade is increased, the following problem is caused.

Specifically, as illustrated in FIG. 8A, when the contact pressure of a cleaning blade 62 is increased, the friction between the cleaning blade 62 and an image bearer 123 is increased, and a tip edge 62*c* of a tip surface 62*a* of the cleaning blade 62 is pulled by the moving surface of the image bearer 123 in the moving direction of the image bearer 123, thereby everting the tip edge portion of the tip surface

62*a* of the cleaning blade 62. In this regard, since the thus everted tip edge portion of the cleaning blade 62 has a restoring force, the tip edge portion tends to vibrate, resulting in generation of fluttering sounds (hereinafter referred to as a fluttering sound problem). In addition, when the cleaning operation is continued while the tip edge portion of the cleaning blade 62 is everted, a portion of the tip surface 62*a* of the cleaning blade 62, which portion is few micrometers away from the tip edge 62*c*, is abraded as illustrated in FIG. 8B. When the cleaning blade 62 is further used for the cleaning operation, the portion of the tip surface 62*a* of the cleaning blade 62 is further abraded, resulting in lack of the tip edge 62*c* of the cleaning blade 62 as illustrated in FIG. 8C. The cleaning blade 62 having no tip edge hardly removes residual toner from the surface of the image bearer 123, thereby causing a cleaning problem in that an abnormal image in which background thereof is soiled with residual toner is formed.

In FIGS. 8A-8C, numeral 62*b* denotes a lower surface of the cleaning blade 62, which faces the surface of the image bearer 123 to be cleaned.

A cleaning blade is proposed which includes an elastic blade and an outermost layer covering the tip edge portion of the elastic blade, wherein at least the tip edge portion of the elastic blade is impregnated with an ultraviolet crosslinked resin, and the outermost layer is formed of an ultraviolet crosslinked resin. In this regard, a mixture of a fluorine-containing acrylic monomer, an acrylate material including as a main skeleton a pentaerythritol triacrylate while having a functional group equivalent molecular weight (i.e., molecular weight of a compound per one functional group of the compound) of not greater than 350 and 3 to 6 functional groups, and another acrylate material having a functional group equivalent molecular weight of from 100 to 1,000 and 1 to 2 functional groups is used for the ultraviolet crosslinked resin.

It is described in the proposal that by impregnating the elastic blade with the above-mentioned ultraviolet crosslinking resin, the hardness of the tip edge portion of the elastic blade can be enhanced, and thereby deformation (eversion) of the tip edge portion in the moving direction of the image bearer can be prevented. In addition, it is described therein that even when the outermost layer is abraded after long repeated use and the tip edge portion of the elastic blade is revealed, the tip edge portion of the elastic blade, which includes the ultraviolet crosslinked resin, is contacted with the surface of the image bearer, and therefore the friction between the elastic blade and the image bearer is relatively low, resulting in prevention of deformation of the tip edge portion of the elastic blade. Namely, it is described therein that the cleaning blade can prevent deformation (eversion) of the tip edge portion thereof while enhancing the abrasion resistance thereof, thereby making it possible to prevent occurrence of the above-mentioned cleaning problem even when the cleaning blade is used over a long period of time.

SUMMARY

As an aspect of this disclosure, a cleaning blade is provided which includes a strip-shaped elastic blade, wherein the tip edge portion of the elastic blade is to be contacted with the surface of a moving object to remove a powdery material from the surface of the moving object. At least the tip edge portion includes an ultraviolet crosslinked resin, which includes an acrylate or methacrylate unit including a fluorine-containing group, and another acrylate or methacrylate unit having a tricyclodecane or adamantane skeleton, from the surface of the tip edge portion to a depth of not less than 5 μm.

As another aspect of this disclosure, an image forming apparatus is provided which includes a rotatable image bearer to bear a visible image thereon, a transferring device to transfer the visible image to a recording medium optionally via an intermediate transfer medium, and a cleaner including the above-mentioned cleaning blade to clean the surface of the image bearer after the visible image on the surface of the image bearer is transferred to the recording medium or the intermediate transfer medium by contacting the tip edge portion of the cleaning blade with the surface of the image bearer.

As another aspect of this disclosure, a process cartridge is provided which includes an image bearer to bear a visible image thereon, and a cleaner including the above-mentioned cleaning blade to clean the surface of the image bearer after the visible image on the surface of the image bearer is transferred to a recording medium by contacting the tip edge portion of the cleaning blade with the surface of the image bearer. The process cartridge is detachably attachable to an image forming apparatus as a single unit.

As another aspect of this disclosure, a method for preparing the above-mentioned cleaning blade is provided which includes impregnating a tip portion of a strip-shaped elastic rubber plate with a curable material including an acrylate or methacrylate having a fluorine-containing group, and another acrylate or methacrylate having a tricyclodecane or adamantane skeleton from a surface of the tip portion to a depth of not less than 5 μm, wherein the tip portion includes at least a tip edge portion of the elastic rubber plate; and curing the curable material with ultraviolet rays to prepare the cleaning blade.

The aforementioned and other aspects, features and advantages will become apparent upon consideration of the following description of the preferred embodiments taken in conjunction with the accompanying drawings.

DETAILED DESCRIPTION

When an outermost layer, which is made of a material having a high hardness such as ultraviolet crosslinked resins, is formed on the tip edge portion of an elastic blade, deformation of the tip edge portion of the elastic blade can be prevented. However, when an ultraviolet crosslinkable resin is crosslinked, the resin tends to be shrunk largely, and thereby problems such that the outermost layer is cracked or clipped off, and the outermost layer is peeled from the elastic blade are often caused. In addition, such a cleaning blade is typically used for image forming apparatus in which a lubricant is applied to an image bearer to protect the surface of the image bearer. Therefore, even when the outermost layer is abraded and the tip edge portion of the elastic blade which is impregnated with the ultraviolet crosslinkable resin is revealed, the friction between the cleaning blade and the image bearer can be maintained so as to be relatively low. However, it is confirmed from the present inventors' experiments that when the cleaning blade is used for image forming apparatus in which no lubricant is applied to the image bearer thereof, both the surface of the image bearer and the cleaning blade are abraded, and in addition the external additive and wax included in the toner are melted and adhere to the surface of the image bearer (because a film of a lubricant is not present between the surface of the image bearer and the cleaning blade), thereby forming a film of the external additive and wax on the surface of the image bearer (i.e., causing a filming problem).

The object of this disclosure is to prevent occurrence of the above-mentioned problems, and is to provide a cleaning blade, which can lessen abrasion loss of the surface of an image bearer and the surface of the cleaning blade even when the cleaning blade is used over a long period of time and which hardly causes the filming problem even when no lubricant is applied to the image bearer.

Hereinafter, an electrophotographic printer (hereinafter referred to as a printer) will be described as one example of an image forming apparatus according to an embodiment.

The main portion of the printer will be described by reference to FIG. 1, which is a schematic view illustrating the entirety of the printer.

Figure 1:
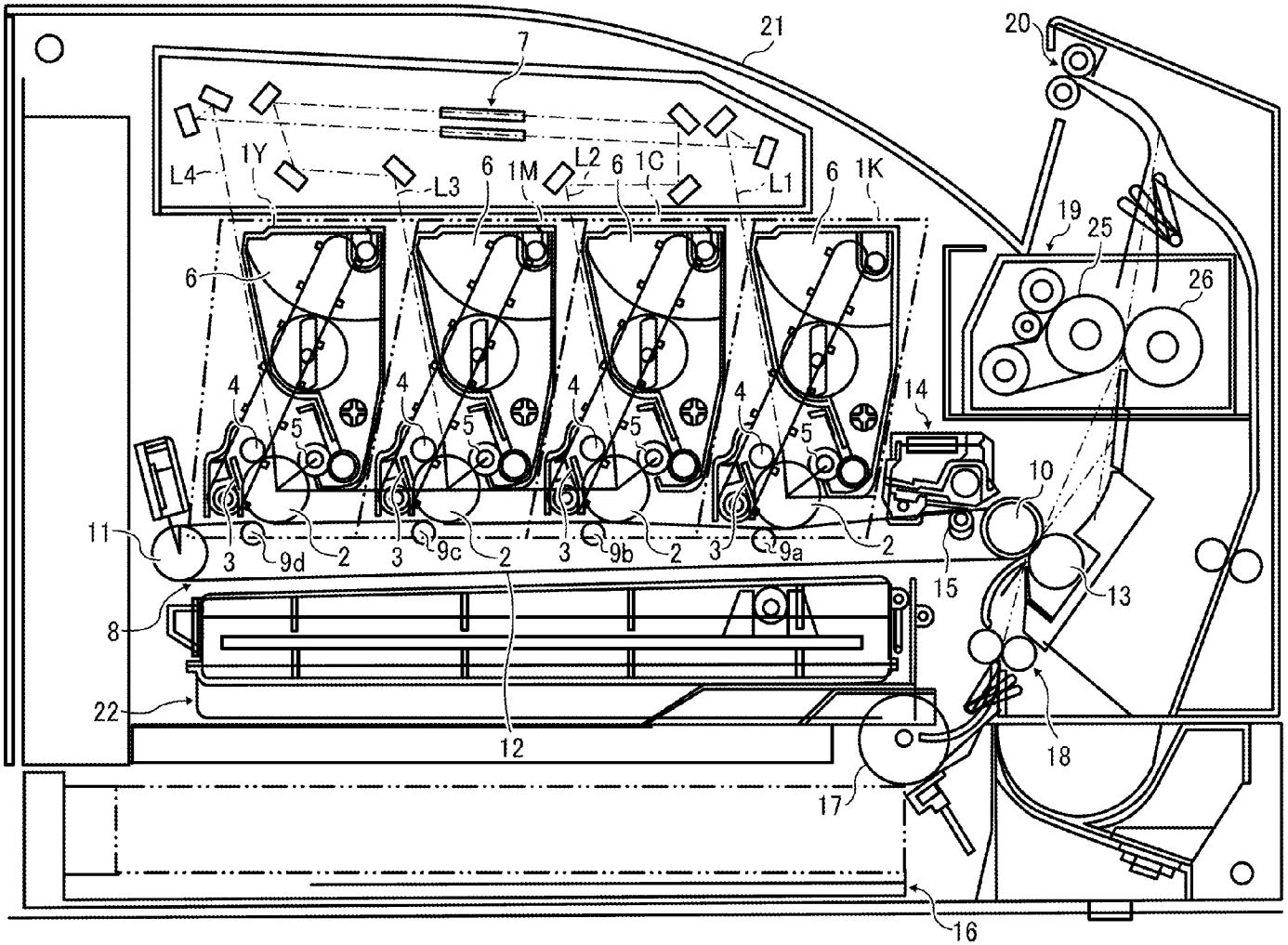
FIG. 1 is a schematic view illustrating a printer as one example of an image forming apparatus according to an embodiment.

Referring to FIG. 1, the printer includes four process units 1K, 1C, 1M and 1Y, which serve as an image forming part and which respectively produce black (K), cyan (C), magenta (M) and yellow (Y) images using developers including K, C, M and Y toners based on color separation images of an original color image. Since the process units 1K, 1C, 1M and 1Y have a similar configuration except that the color of the toners included in the developers is different from each other, only the process unit 1K will be described as an example of the process units 1K, 1C, 1M and 1Y.

The process unit 1K includes a photoconductor 2 serving as an image bearer, a cleaner 3, a charger 4, a developing device 5, and a toner storage portion 6. The process unit 1K is detachably attached to the main body of the printer. The printer further includes an irradiator 7, which is located above the process units 1K, 1C, 1M and 1Y. The inudiator 7 emits laser beams L1, L2, L3 and L4 from a laser diode based on image data.

The printer further includes a transfer belt device 8, which is located below the process units 1K, 1C, 1M and 1Y. The transfer belt device 8 includes an intermediate transfer belt 12 to which toner images formed on the photoconductors 2 are transferred. The intermediate transfer belt 12 is looped over primary transfer rollers 9*a*, 9*b*, 9*c* and 9*d* (which are arranged so as to be opposed to the corresponding photoreceptors 2), a driving roller 10, a tension roller 11, and a cleaning backup roller 15 so as to be driven to rotate. In addition, a secondary transfer roller 13 is arranged so as to be opposed to the driving roller 10, and a belt cleaner 14 is arranged so as to be opposed to the cleaning backup roller 15.

Further, a sheet feeding cassette 16 which can contain a number of sheets of a recording medium, and a sheet feeding roller 17 to feed the sheets one by one from the sheet feeding cassette 16 are arranged at a lower side of the printer. A pair of registration rollers 18 is provided at a location between the sheet feeding roller 17 and the nip of the driving roller 10 with the secondary transfer roller 13.

A fixing device 19 including a fixing roller 25 and a pressure roller 26 is provided above the nip of the driving roller 10 with the secondary transfer roller 13. Further, a pair of sheet ejection rollers 20 to eject a recorded sheet of the recording medium (i.e., a print) from the printer is provided above the fixing device 19. The recorded sheet ejected by the pair of sheet ejection rollers 20 is stacked on a sheet ejection tray 21, which is formed by recessing the upper surface of the printer toward the inner portion of the printer.

A waste toner container 22 to contain waste toners is provided at a location between the transfer belt device 8 and the sheet feeding cassette 16. A waste toner feeding hose is provided at the entrance of the waste toner container 22 while connected with the belt cleaner 14 to feed waste toners to the waste toner container 22 from the belt cleaner 14.

Figure 2:
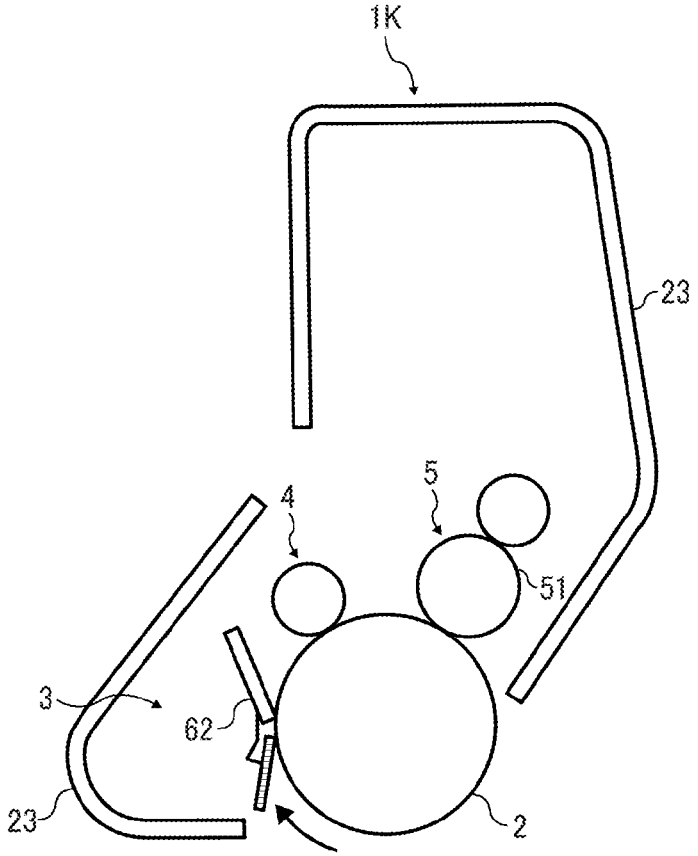
FIG. 2 is a schematic view illustrating an example of a process cartridge according to an embodiment.

FIG. 2 illustrates the process unit 1K, which is detached from the main body of the printer or which is to be attached to the printer. As illustrated in FIG. 2, the process unit 1K includes a chassis 23, which is formed by subjecting a resin to injection molding. Specific examples of the resin used for the chassis 23 include polycarbonate resins, acrylonitrile-butadiene-styrene resins, acrylonitrile-styrene resins, styrene resins, polyphenylene ether resins, polyphenylene oxide resins, polyether terephthalate resins, and alloy resins of these resins. The photoconductor 2, the cleaner 3 including a cleaning blade 62, the charger 4, and the developing device 5 including a developing roller 51. are arranged inside the chassis 23.

Next, the image forming operation of the printer will be described by reference to FIGS. 1 and 2.

When the printer receives a print execution signal from an operating part (not shown), a predetermined voltage or current is applied to each of the chargers 4 and the developing rollers 51 at a predetermined time. Similarly, a predetermined voltage or current is applied to each of the irradiator 7 and discharge lamps (not shown) at a predetermined time. In addition, in synchronization with the activation of these devices, a driving motor (not shown) serving as a driver drives the photoconductors 2 so that the photoconductors 2 rotate in a direction indicated by an arrow (illustrated in FIG. 2).

When the photoconductors 2 rotate in the direction indicated by the arrow, the photoconductors 2 are charged by the corresponding chargers 4 so as to have a predetermined potential. Next, the irradiator 7 irradiates the charged surfaces of the photoreceptors 2 with light L1, L2, L3 and L4, respectively, which are modulated by image signals of a color image (original image), thereby forming electrostatic latent images corresponding to the black (K), cyan (C), magenta (M) and yellow (Y) images on the photoconductors 2 in which the potentials of the irradiated portions of the surface of the photoconductors 2 are decreased so as to be relatively low than the potentials of the dark portions.

The portions of the photoconductors 2 bearing the electrostatic latent images thereon are fed toward the corresponding developing devices 5, and are rubbed with magnetic brushes of the developers, which are formed on the developing rollers 51. In this regard, negatively charged toners on the developing rollers 51 are moved toward the electrostatic latent images by predetermined developing biases applied to the developing rollers 51, thereby forming K, C, M and Y toner images on the photoconductors 2 (i.e., development is performed). In this printer, the developing devices 5 perform reversal development (nega/posi (N/P) development) using negatively charged toners. The developing method is not limited to this N/P development using a non-contact developing roller to which a bias is applied.

The color toner images formed on the photoconductors 2 are primarily transferred to the intermediate transfer belt 12 so as to be overlaid, thereby forming a combined color toner image on the intermediate transfer belt 12. The combined color toner image on the intermediate transfer belt 12 is transferred onto a recording medium, which is timely fed to a secondary transfer nip between the intermediate transfer belt 12 and the secondary transfer roller 13 by the pair of registration rollers 18 so that the combined color toner image is transferred to a proper position of the recording medium. In addition, a transfer bias is applied to the secondary transfer roller 13 when the combined color toner image is transferred to the recording medium. The recording medium bearing the combined color toner image thereon is separated from the intermediate transfer belt 12, and fed to the fixing device 19. When the recording medium passes through the fixing device 19, the fixing device 19 applies heat and pressure thereto to fix the combined color toner image to the recording medium, resulting in formation of a fixed color toner image (i.e., a print). The recording medium bearing the fixed color toner image thereon is then ejected from the printer by the pair of sheet ejection rollers 20.

After the toner images are transferred, the cleaning blades 62 of the cleaners 3 remove residual toners from the surfaces of the corresponding photoconductors 2, and the discharging lamps (not shown) remove residual charges from the corresponding photoconductors 2.

In this printer, the photoconductor 2, and the process devices such as the cleaner 3, the charger 4 and the developing device 5 are arranged in the chassis 23 as a single unit (i.e., process cartridge) as illustrated in FIG. 2 so that the process cartridge is detachably attachable to the printer. However, the printer may have a configuration such that the photoconductor 2, and the process devices such as the cleaner 3, the charger 4, and the developing device 5 are independently replaced with a new photoconductor or a new process device.

Next, toner suitable for the printer will be described.

The toner is preferably a toner having a high circularity and a small particle diameter to produce high quality images. Such a toner is preferably prepared by a polymerization method such as suspension polymerization methods, emulsion polymerization methods, and dispersion polymerization methods. It is more preferable to use a toner having an average circularity of not less than 0.97, and a volume average primary particle diameter of not greater than 5.5 μm to produce higher resolution toner images.

The average circularity of toner is measured using a flow particle image analyzer FPIA-2000 from Sysmex Corp. The procedure is the following.

(1) Initially, 100 to 150 ml of water, from which solid foreign materials have been removed, a dispersant (preferably 0.1 to 0.5 ml of a surfactant (e.g., alkylbenzenesulfonate)), and 0.1 to 0.5 g of a sample (i.e., toner) are mixed to prepare a dispersion (suspension);

(2) The suspension is further subjected to a supersonic dispersing treatment for 1 to 3 minutes using a supersonic dispersing machine to prepare a dispersion including particles of the sample at a concentration of from 3,000 to 10,000 pieces/μl;

(3) The thus prepared dispersion is set in the analyzer so that the particles pass through a detection area formed on a plate in the analyzer; and (4) The particles of the sample passing through the detection area are optically detected by a CCD camera, and then the shapes of the toner particles and the distribution of the shapes are analyzed with an image analyzer to determine the average circularity of the sample.

Figure 3A:
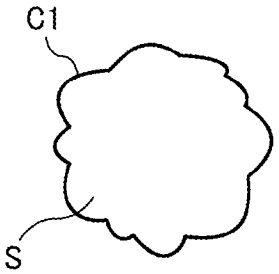
FIGS. 3A and 3B are views for use in describing the way to measure the circularity of toner.
Figure 3B:
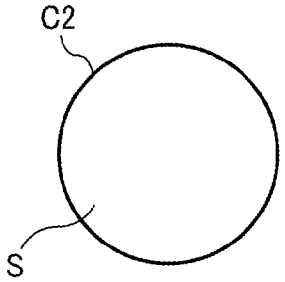

The method for determining the circularity of a particle will be described by reference to FIGS. 3A and 3B. When the projected image of a particle has a perimeter C1 and an area S as illustrated in FIG. 3A, and the perimeter of a circle having the same area S is C2 as illustrated in FIG. 3B, the circularity of the particle can be obtained by the following equation.

$$\text{Circularity}=C2/C1$$

The average circularity of a toner is obtained by averaging circularities of particles of the toner.

The volume average particle diameter of toner can be determined, for example, by a Coulter Counter method using an instrument, COULTER MULTICIZER 2e manufactured by Beckman Coulter Inc. Specifically, the number-size particle diameter distribution data and the volume-basis particle diameter distribution data are sent to a personal computer via an interface manufactured by Nikkaki Bios Co., Ltd. to be analyzed. Specifically, the procedure is the following.

(1) A surfactant serving as a dispersant, preferably 0.1 to 5 ml of a 1% aqueous solution of an alkylbenzenesulfonic acid salt, is added to 100 to 150 ml of an electrolyte, which is a 1% aqueous solution of first class NaCl;

(2) Two (2) to 20 milligrams of a sample (toner) to be measured is added into the mixture;

(3) The mixture is subjected to an ultrasonic dispersion treatment for about 1 to 3 minutes;

(4) The dispersion is added to 100 to 200 ml of the aqueous solution of the electrolyte in a beaker so that the mixture includes the particles at a predetermined concentration; and (5) The thus diluted dispersion is set in the instrument to measure particle diameters of 50,000 particles using an aperture of 100 μm to determine the volume average particle diameter of the sample.

When measuring the volume average particle diameter, the following 13 channels are used:

(1) Not less than 2.00 μm and less than 2.52 μm;
(2) Not not less than 2.52 μm and less than 3.17 μm;
(3) Not less than 3.17 μm and less than 4.00 μm;
(4) Not less than 4.00 μm and less than 5.04 μm;
(5) Not less than 5.04 μm and less than 6.35 μm;
(6) Not less than 6.35 μm and less than 8.00 μm;
(7) Not less than 8.00 μm and less than 10.08 μm;
(8) Not less than 10.08 μm and less than 12.70 μm;
(9) Not less than 12.70 μm and less than 16.00 μm;
(10) Not less than 16.00 μm and less than 20.20 μm;
(11) Not less than 20.20 μm and less than 25.40 μm;
(12) Not less than 25.40 μm and less than 32.00 μm; and
(13) Not less than 32.00 μm and less than 40.30 μm.

Namely, particles having a particle diameter of from 2.00 μm to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

Next, the cleaning blade of this disclosure will be described by reference to drawings.

Figure 4:
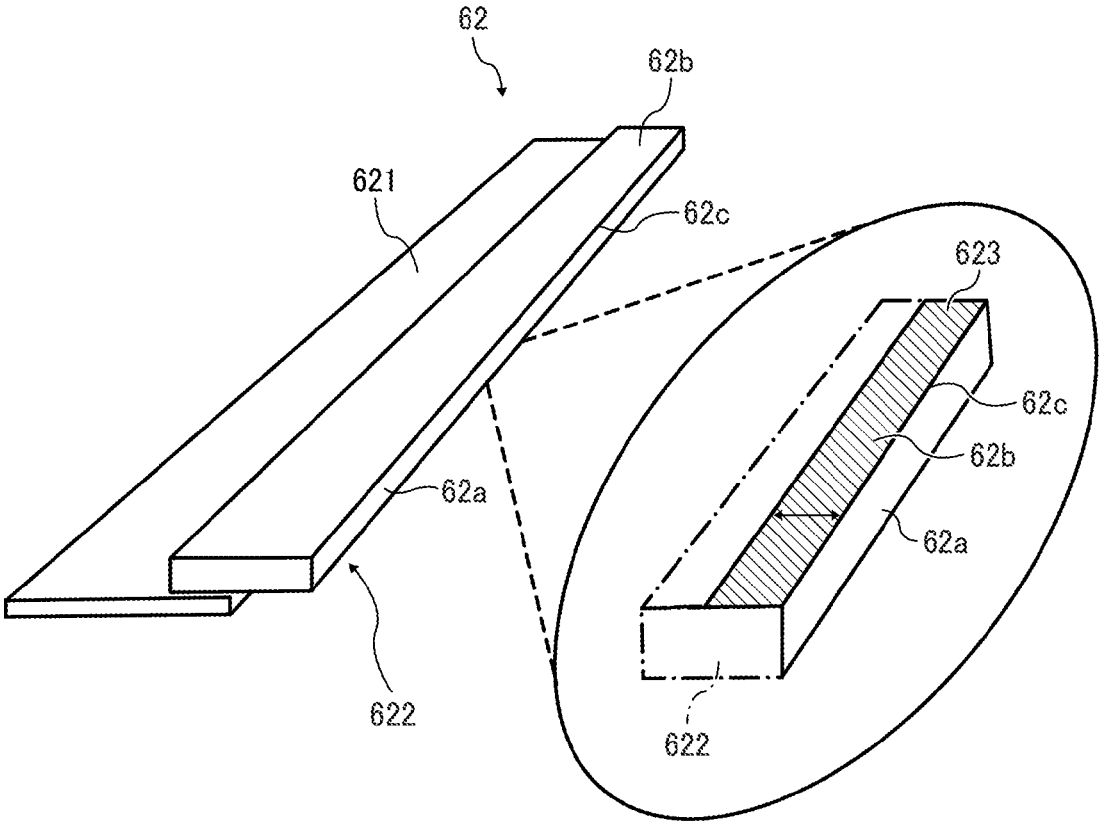
FIG. 4 is a perspective view illustrating an example of a cleaning blade according to an embodiment.
Figure 5A:
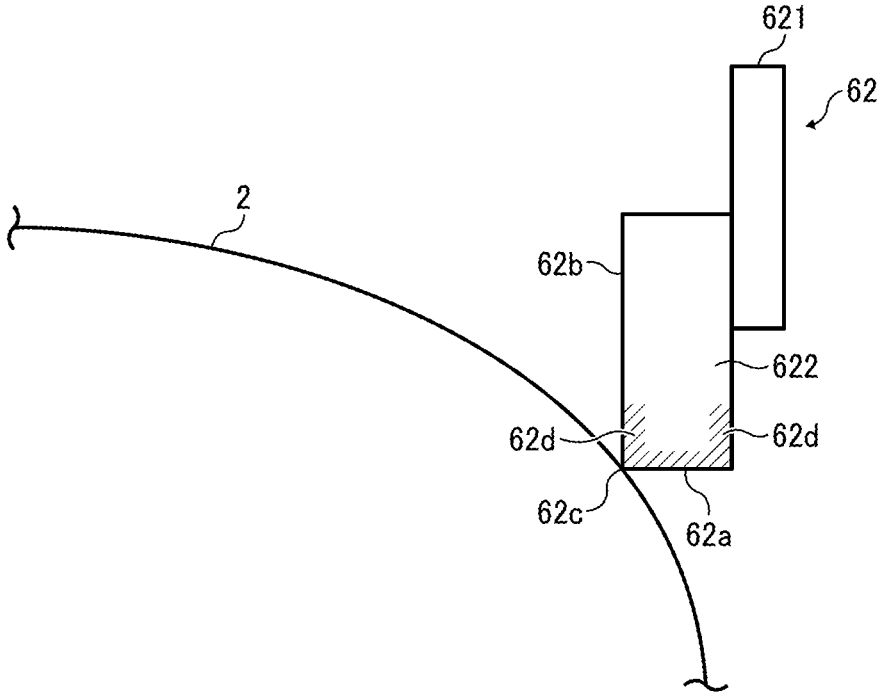
FIG. 5A is a schematic cross-sectional view illustrating the cleaning blade, which is contacted with an image bearer.
Figure 5B:
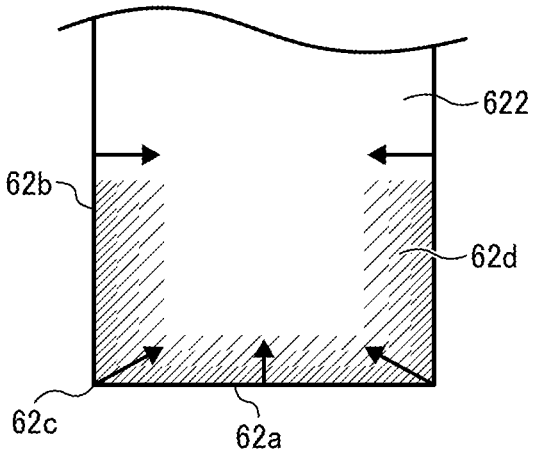
FIG. 5B is a schematic cross-sectional view illustrating the tip portion of the cleaning blade.

FIG. 4 is a schematic perspective view illustrating a cleaning blade 62 of this disclosure. FIG. 5A is a schematic cross-sectional view illustrating the cleaning blade 62, which is contacted with the surface of the photoconductor 2. FIG. 5B is a schematic cross-sectional view illustrating a tip portion of the cleaning blade 62.

The cleaning blade 62 includes a strip-shaped holder 621 which is made of a rigid material such as metals and hard plastics, and a strip-shaped elastic blade 622.

The elastic blade 622 is fixed to an end portion of the holder 621, for example, by an adhesive. The other end portion of the holder 621 is supported (cantilevered) by a case of the cleaner 3. In order that the elastic blade 622 can be satisfactorily contacted with the surface of the photoconductor 2 even if the photoconductor 2 is eccentric or the surface thereof is waved, the elastic blade 622 is typically made of a material having a high impact resilience coefficient, preferably urethane rubbers which have a urethane group. The elastic blade 622 can have a two or more-layer structure such that materials having different JIS-A hardness are laminated as well as a single-layer structure. In this regard, the JIS-A hardness is measured by the method described in JIS K6253 while using a micro rubber hardness tester MD-1, which is manufactured by KOBUNSHI KEIKI CO., LTD. and which uses a pressing plate and a pressing needle and determines hardness of a sample based on the travel distance of the pressing needle.

The elastic blade 622 is preferably made of a urethane rubber, which has hardness properties such that the peak temperature of tan δ (loss tangent) measured with a dynamic viscoelasticity measuring instrument, DMS 6100 from Seiko Instruments Inc. is not lower than 0° C., and the difference between the JIS-A hardness at 23° C. and the JIS-A hardness at 10° C. is not less than 5°.

When the elastic blade 622 has a two or more-layer structure such that materials having different JIS-A hardness are laminated, urethane rubbers having the above-mentioned hardness properties are preferably used for the elastic blade 622. In this case, it is preferable to select a proper material from such urethane rubbers for each of the contact side of the elastic blade 622 to be contacted with the photoconductor 2, and the non-contact side of the elastic blade 622 to be attached to the holder 621. When a two or more-layer urethane blade is prepared, it is preferable to continuously inject raw materials of the urethane rubbers into a molding die before the layers are perfectly hardened so that the resultant molded blade does not cause a delamination problem.

A tip portion 62*d* including a tip edge portion 62*c* of the elastic blade 622 is subjected to an impregnation treatment, which will be described later in detail. The impregnation treatment can be performed by a method in which the tip portion 62*d* of the elastic blade 622 is impregnated with a coating liquid including an ultraviolet curable resin using a coating method such as brush coating, spray coating, and dip coating. In this regard, the coating liquid used for the impregnation treatment includes an acrylic or methacrylic monomer, which includes a fluorine-containing group and which imparts good lubricating property to the elastic blade 622, and another acrylate or methacrylate having a tricyclodecane or adamantane skeleton, which imparts a good combination of hardness and elasticity to the elastic blade 622. The depth (thickness) of the impregnated tip portion 62*d* is preferably not less than 5 μm, so that even when the elastic blade 622 itself is abraded, fluorine included inside the elastic blade 622 serves as a lubricant, thereby making it possible to maintain the friction coefficient of the elastic blade 622 with the photoconductor 2, and the friction coefficient of the elastic blade 622 with the toner so as to be relatively low. In addition, since the elastic blade 622 having such an impregnated tip portion 62*d* can have a high hardness, deformation of the tip portion 62*d* of the cleaning blade 62 can be prevented. Further, since the elastic blade 622 can have a high elasticity, the cleaning blade 62 can maintain good photoconductor following capacity. The elastic blade 622 thus subjected to the impregnation treatment can maintain good abrasion resistance over a longer period of time than an elastic blade whose tip portion is covered with a thin outermost layer. It is preferable that the impregnated resin forms a crosslinking structure inside the elastic blade 622. In this case, the tip portion 62*d* can have a higher hardness, and thereby the deformation preventing effect can be effectively produced. It is more preferable that at least the acrylate or methacrylate monomer including a fluorine-containing group (and preferably each of the acrylate or methacrylate monomer including a fluorine-containing group, and the acrylate or methacrylate having a tricyclodecane or adamantane skeleton) has a low molecular weight of not greater than 500, because the impregnation treatment can be efficiently performed, and the materials can be easily impregnated into the inside of the elastic blade, resulting in increase of the thickness of the impregnated portion (i.e., fluorine-containing portion), thereby making it possible for the elastic blade to maintain low friction coefficient even when the elastic blade is abraded.

The acrylate or methacrylate having a tricyclodecane or adamantane skeleton, which can impart a good combination of hardness and elasticity to the elastic blade 622, can compensates for the lack of crosslinkage points due to the special structure of the tricyclodecane or adamantane skeleton even when the number of functional groups is relatively small. Therefore, the inner portion of the elastic blade impregnated with the material can have a good combination of hardness and elasticity. When the elastic blade 622 has a high hardness, the cleaning blade 62 can prevent deformation of the tip portion 62*d* thereof. In addition, when the elastic blade 622 has a high elasticity, the cleaning blade 62 can maintain the photoconductor following capacity.

Specific examples of the acrylate or methacrylate having a tricyclodecane or adamantane skeleton include tricyclodecane dimethanol diacrylate, 1,3-adamantane dimethanol diacrylate, 1,3-adamantane dimethanol dimethacrylate, 1,3,5-adamantane trimethanol triacrylate, 1,3,5-adamantane trimethanol trimethacrylate, and the like. These can be used alone or in combination.

The number of functional groups of the acrylate or methacrylate having a tricyclodecane or adamantane skeleton is preferably from 1 to 6, and more preferably from 2 to 4. When the number of functional groups is one, the crosslinkage structure is relatively weak, and when the number of functional groups is not less than 5, steric hindrance can occur. Therefore, when using a (meth)acrylate having a tricyclodecane or adamantane skeleton and having one or not less than functional groups, it is preferable to mix another acrylate or methacrylate having different number of functional groups (of from 2 to 4) therewith.

It is also preferable that the molecular weight of the acrylate or methacrylate having a tricyclodecane or adamantane skeleton is not greater than 500 so that the impregnation treatment can be efficiently performed.

The coating liquid used for the impregnation treatment can further include an acrylate monomer having a molecular weight of not greater than 500. Among such acrylate monomers, acrylate monomers, which have a pentaerythritol triacrylate skeleton and which have a functional equivalent molecular weight of not greater than 350 while including 3 to 6 functional groups, are preferable. When such an acrylate monomer is further included in the coating liquid, the hardness of the tip portion 62*d* of the elastic blade 622 can be further enhanced, thereby making it possible to securely prevent deformation of the tip portion 62*d* of the elastic blade 622.

Specific examples of such an acrylate monomer include dipentaerythritol hexaacrylate, pentaerythritol tetraacrylate, pentaerythritol triacrylate, pentaerythritolethoxy tetraacrylate, trimethylolpropane triacryalte, trimethylolpropaneethoxy triacryalte, 1,6-hexanediol diacrylate, ethoxylated bisphenol A diacrylate, propoxylated ethoxylated bisphenol A diacrylate, 1,4-butanediol diacrylate, 1,5-pentanediol diacrylate, 1,7-heptanediol diacrylate, 1,8-octanediol diacrylate, 1,9-nonanediol diacrylate, 1,10-decanediol diacrylate, 1,11-undecanediol diacrylate, 1,18-octadecanediol diacrylate, glycerin propoxy triacrylate, dipropylene glycol diacrylate, tripropylene glycol diacrylate, polyoxyethylene-modified neopentyl glycol diacrylate, polyethylene glycol (600) diacrylate, polyethylene glycol (400) diacrylate, polyethylene glycol (200) diacrylate, neopentyl glycol-hydroxypivalic acid ester diacrylate, octyl/decy acrylate, isobonyl acrylate, ethoxylated phenyl acrylate, 9,9-bis [4-(2-acryloyloxyethoxyl)phenyl]fluorenone, and the like. These can be used alone or in combination. In order to efficiently perform the impregnation treatment, the molecular weight of the acrylate monomer to be mixed is preferably not greater than 500.

The coating liquid can include a diluent. It is preferable for the diluent to be able to dissolve the ultraviolet curable resin used while having a relatively low boiling point. The boiling point of the diluent is preferably not higher than 160° C., and more preferably not higher than 100° C. Specific examples of such a diluent include organic solvents such as hydrocarbon solvents (e.g., toluene and xylene), ester solvents (e.g., ethyl acetate, n-butyl acetate, methyl cellosolve acetate, and propylene glycol monomethyl ether acetate), ketone solvents (e.g., methyl ethyl ketone, methyl isobutyl ketone, diisobutyl ketone, cyclohexanone, cyclopentanone, and acetone), ether solvents (e.g., ethylene glycol monomethyl ether, ethylene glycol monoethyl ether, and propylene glycol monomethyl ether), alcohol solvents (e.g., ethanol, propanol, 1-butanol, isopropyl alcohol, and isobutyl alcohol), and the like.

When a diluent is included in a coating liquid, the amount of the coating liquid penetrating into a rubber (such as elastic blade) can be increased, but the diluent tends to remain in the rubber, thereby causing a problem in that the rubber is swelled by the residual diluent, resulting in thickening of the rubber and deterioration of properties of the rubber such as abrasion resistance. In this regard, when the rubber is heated to remove the residual diluent, the properties of the rubber deteriorate, resulting in deterioration of the cleaning properties of the rubber. Therefore, when a diluent is used for the coating liquid for use in the impregnation treatment, it is preferable that the impregnated elastic blade is heated at a relatively low temperature or subjected to vacuum drying to decrease the amount of residual diluent.

The depth of the portion of the elastic blade 622 impregnated with an acrylate or methacrylate monomer having a fluorine-containing group and another acrylate or methacrylate having a tricyclodecane or adamantane skeleton is preferably not less than 5 μm. In this case, deformation of the tip portion 62*d* of the elastic blade 622 can be prevented, thereby making it possible to prevent occurrence of eversion of the tip of the elastic blade 622.

When the depth of the impregnated portion of the elastic blade 622 is not less than 5 μm, the lubricating effect of the unit formed of the acrylate or methacrylate monomer having a fluorine-containing group can be produced even when the cleaning blade 62 is used over a long period of time and the tip edge portion 62*c* of the cleaning blade 62 is abraded. When the depth is less than 5 μm, the fluorine-containing portion of the cleaning blade 62 tends to be lost relatively promptly, and thereby the lubricating effect is not produced. In this case, friction between the photoconductor 2 and the cleaning blade 62 increases, and the abrasion speed of the photoconductor 2 and the cleaning blade 62 is increased, resulting in shortening of the lives of the photoconductor 2 and the cleaning blade 62. In addition, when the lubricating effect of fluorine is not produced, residual toner particles on the surface of the photoconductor 2 adhere to the tip edge portion 62*c* of the cleaning blade 62. In this case, even when other residual toner particles enter into the nip between the tip edge portion 62*c* and the surface of the photoconductor 2, the residual toner particles adhered to the tip edge portion 62*c* are packed without released from the nip. Since constituents (such as external additives and waxes) of the packed toner particles are melted by the friction heat, a film of the constituents is formed on the surface of the photoconductor 2 (i e, a filming phenomenon (filming problem) is caused), thereby forming abnormal images.

If a lubricant applicator is provided to apply a lubricant to the surface of the photoconductor 2, early abrasion of the photoconductor 2 and the cleaning blade 62 and occurrence of the filming phenomenon can be prevented. However, proving such a lubricant applicator causes other problems such that costs of the image forming apparatus increase due to increase of the number of parts, and the image forming apparatus enlarges in size.

In contrast, the tip portion of the cleaning blade of this disclosure is impregnated with a coating liquid including an acrylate or methacrylate monomer having a fluorine-containing group so that the depth of the impregnated portion is not less than 5 μm, and therefore good lubricating effect can be maintained over a long period of time. Therefore, early abrasion of the photoconductor and the cleaning blade and occurrence of the filming phenomenon can be prevented without using such a lubricant applicator as mentioned above. As a result, occurrence of the above-mentioned problems caused by providing a lubricant applicator can be prevented.

The depth of the impregnated portion can be measured by a method using a microhardness tester HM-2000 from Fischer Instruments K.K. Specifically, the hardness of the cross-section of the surface portion 62*d* of the tip portion of the cleaning blade 62 is measured with the microhardness tester before and after the impregnation treatment to determine whether the hardness of the surface portion increases. In this regard, the portion whose hardness is increased is considered to be the impregnated portion, and the thickness of the portion is considered to be the depth of the impregnated portion.

The present inventors prepared several conventional cleaning blades by impregnating an elastic blade (i.e., urethane rubbers 1 and 2 mentioned below) with a coating liquid including an ultraviolet curable resin composition, which includes an acrylic or methacrylic monomer having a fluorine-containing group and a molecular weight of greater than 500, an acrylate material having a pentaerythritol triacrylate unit as a main skeleton while having 3 to 6 functional groups and a functional group equivalent molecular weight of not greater than 350, and an acrylate material having for 2 functional groups and a functional group equivalent molecular weight of from 100 to 1000, and measured the depth of the impregnated portion by the method mentioned above. As a result, the depth of the impregnated portions of these conventional cleaning blades was not less than 5 μm (i.e., the hardness of the surface portions of the conventional cleaning blades was increased). However, the conventional cleaning blades could not prevent occurrence of the above-mentioned problems (i.e., early abrasion of the photoconductor and the cleaning blade and occurrence of the filming phenomenon) although occurrence of the problem in that the tip edge of the cleaning blade is everted could be prevented.

The present inventors investigated the reason therefor, and formed a hypothesis that the depth of the portion impregnated with the acrylic or methacrylic monomer having a fluorine-containing group and a molecular weight of greater than 500 is less than 5 μm although the depth of the portion impregnated with the other monomers is not less than 5 μm. In order to verify the hypothesis, the present inventors performed the following analysis. Specifically, the cleaning blades were analyzed by a time-of-flight secondary ion mass spectrometer (TOF-SIMS). As a result, it was found that the depth of the portion impregnated with the acrylic or methacrylic monomer having a fluorine-containing group and a molecular weight of greater than 500 is about 1 μm.

Thus, it was found that the acrylic or methacrylic monomer having a fluorine-containing group does not deeply penetrate into the elastic blade (the depth is less than 5 μm) although the other monomers deeply penetrate into the elastic blade (the depth is not less than 5 μm), and therefore, the fluorine-containing portion of the elastic blade is early abraded, resulting in loss of the lubricating effect of fluorine, thereby causing the problems (i.e., early abrasion of the photoconductor and the cleaning blade and occurrence of the filming phenomenon).

The above-mentioned TOF-SIMS can detect components (atoms and molecules) of an organic or inorganic solid material (sample) present on the outermost surface of the solid material on the order of ppm. Specifically, in the TOF-SIMS, when a high-speed ion beam (primary ion) strikes the surface of a solid material in vacuum, the components present on the surface of the sample are sputtered (i.e., sputtering phenomenon). In this case, ions with a positive or negative charge (i.e., secondary ions) generated by the primary ion are carried in one direction by an electric field to be detected at a location a predetermined distance away from the sample. In the sputtering phenomenon, various secondary ions having different weights are generated depending on the composition of the surface of the sample. Among these secondary ions, ions having lighter weights can be carried faster. Therefore, by measuring the time of flight of a secondary ion (i.e., time period of from generation of a secondary ion to detection of the ion), the weight of the secondary ion can be determined. In the TOF-SIMS, since irradiance of the primary ion is very small, an organic compound can be ionized while maintaining the chemical structure thereof, and the structure of the organic compound can be determined based on the mass spectrum. In addition, since only the secondary ions generated from the outer surface of a solid sample can fly into vacuum, the information on the outermost surface (i.e., a surface portion with a depth of about few angstroms (A=0.1 nm)) of the solid sample can be obtained. Further, by scanning the surface of the sample with the primary ion beam, the ion image (i.e., ion map) of the surface of the sample can be obtained.

Figure 6:
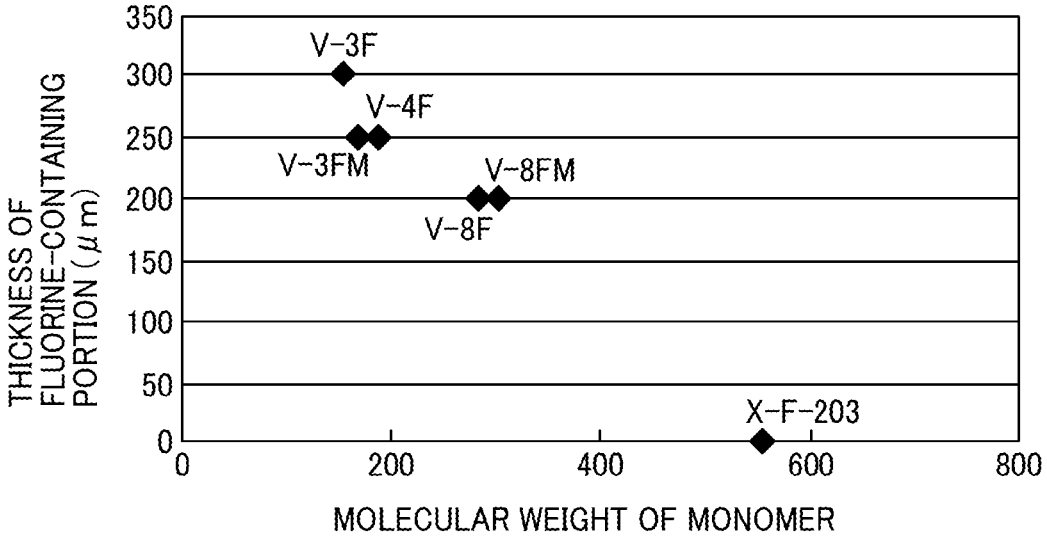
FIG. 6 is a graph illustrating the relation between molecular weight of a (meth)acrylic monomer including a fluorine-containing group and depth of the fluorine-impregnated portion (i.e., thickness of fluorine-containing portion)

FIG. 6 is a graph illustrating the relation between molecular weight of a (meth)acrylic monomer including a fluorine-containing group and depth of the fluorine-impregnated portion (i.e., thickness of fluorine-containing portion).

In this regard, the (meth)acrylic monomers including a fluorine-containing group used for preparing the graph are V-3F, V-3FM, V-4F, V-8F and V-8FM (manufactured by Osaka Organic Chemical Industry Ltd.), and X-F-203 (manufactured by Idemitsu Kosan Co., Ltd. The elastic blade 622 is dipped into each of the (meth)acrylic monomers for 20 minutes to be impregnated therewith, and the depth of the monomer (fluorine)-impregnated portion (i.e., fluorine-containing portion) is measured by the TOF-SIMS. In the measurement using the TOF-SIMS, the sample is cut using a cryogenic microtome so as to have a predetermined thickness. The cut sample is set on an adhesive tape, and is then fixed on the holder of the TOF-SIMS.

It is clear from FIG. 6 that the depth of the impregnated portion is closely correlated with the molecular weight of the monomer. Specifically, when (meth)acrylic monomers including a fluorine-containing group, which have a molecular weight of not greater than 500, i.e., V-3F, V-3FM, V-4F, V-8F and V-8FM, are used, the depth of the fluorine-containing portion is not less than 200 μm. In addition, in the case of V-3F, which has the smallest molecular weight among the monomers, the depth of the fluorine-containing portion is about 300 μm. In contrast, in the case of X-F-203, which has a molecular weight of greater than 500, the elastic blade is hardly impregnated with the monomer. As a result, it is found that a monomer having a smaller molecular weight can more deeply penetrate into the network structure of the elastic blade.

When the above-mentioned impregnation treatment was performed under the same conditions (dipping time of 20 minutes) using a (meth)acrylic monomer including a fluorine-containing group, OP-TOOL (from Daikin Co., Ltd.), which has a molecular weight of a few thousand and which is described in JP-2013-76970-A, the depth of the impregnated portion was 2 μm.

Such a (meth)acrylic monomer including a fluorine-containing group and having a molecular weight of greater than 500 has low impregnation speed, and it is necessary to perform the impregnation treatment for a long period of time in order that the depth of the impregnated portion becomes 5 μm or more. Namely, using a (meth)acrylic monomer including a fluorine-containing group and having a molecular weight of greater than 500 reduces the manufacturing efficiency of the cleaning blade.

It is found from the results mentioned above that by using a (meth)acrylic monomer including a fluorine-containing group and having a molecular weight of not greater than 500, the tip portion 62*d* including the tip edge portion 62*c* can be impregnated with the monomer to an extent such that the depth of the impregnated portion is not less than 5 μm. In this case, the lubricating effect of the (meth)acrylic monomer including a fluorine-containing group can be produced over a long period of time. Namely, even when the cleaning blade 622 is abraded, the lubricating effect of the (meth)acrylic monomer including a fluorine-containing group can be produced, thereby making it possible to prevent occurrence of the filming problem and abrasion of the photoconductor and the cleaning blade over a long period of time without using a lubricant applicator for the photoconductor 2. Further, by impregnating the tip portion 62*d* of the cleaning blade 62 with a (meth)acrylate having a tricyclodecane or adamantane skeleton to an extent such that the depth of the impregnated portion is not less than 5 μm, the tip edge portion 62*c* of the cleaning blade 62 can be hardened without forming an outermost layer thereon, thereby making it possible to prevent deformation of the tip edge portion 62*c*, resulting in prevention of eversion of the tip edge portion 62*c*. When a cured outermost layer is formed on the tip edge portion 62*c*, the outermost layer is largely shrunk when cured, thereby often causing problems such that the outermost layer is cracked or clipped off, and the outermost layer is peeled from the elastic blade 62. Since the cleaning blade of this disclosure does not have such an outermost layer, occurrence of the problems can be prevented.

In addition, by using a (meth)acrylate having a tricyclodecane or adamantane skeleton, the elasticity of the tip edge portion 62*c* can be enhanced, and thereby the tip edge portion 62*c* can be satisfactorily contacted with the surface of the photoconductor 2 (i.e., the cleaning blade can have good photoconductor 2 following capacity) even if the surface of the photoconductor 2 is microscopically waved, resulting in prevention of occurrence of defective cleaning.

The tip edge portion 62*c* of the cleaning blade 62 can be covered with an outermost layer including an ultraviolet crosslinked resin. In this regard, the ultraviolet crosslinkable resin used for forming the ultraviolet crosslinked resin of the outermost layer is preferably the same as the ultraviolet crosslinkable resin used for impregnating the tip edge portion 62*c* Namely, the ultraviolet crosslinkable resin used for forming the outermost layer includes a (meth)acrylate including a fluorine-containing group and/or a (meth)acrylate having a tricyclodecane or adamantane skeleton.

The cleaning blade of this disclosure can be used for an image forming apparatus including a lubricant applicator to apply a lubricant to the surface of the photoconductor thereof. In this case, both of the lubricating effect of fluorine included in the cleaning blade and the lubricating effect of the lubricant applied to the photoconductor can be maintained over a long period of time. Therefore, abrasion of the photoconductor and the cleaning blade, and occurrence of the filming problem can be prevented more securely over a long period of time.

Next, the verification experiment that the present inventors have made will be described.

In the below-mentioned verification experiment, cleaning blades were produced while changing the material of the elastic blade 622, and the material (curable material) used for the impregnation treatment, and the cleaning blades were subjected to an endurance test.

(Elastic Blade)

The following urethane rubbers 1 and 2, which have the below-mentioned physical properties at 25° C., were used as the elastic blade 622.

(1) Urethane rubber 1, which is manufactured by TOYO TIRE & RUBBER CO., LTD. and which has a hardness of 68° and an impact resilience coefficient of 30%.

(2) Urethane rubber 2, which is manufactured by TOYO TIRE & RUBBER CO., LTD. and which has a two-layer structure, wherein the layer to be contacted with the photoconductor has a hardness of 80° while the other layer has a hardness of 75°, and the impact resilience coefficient of the rubber is 25%.

The hardness of the urethane rubbers 1 and 2 was measured by using a micro rubber hardness tester MD-1 manufactured by KOBUNSHI KEIKI CO., LTD., and the method described in JIS K6253. The hardness of the urethane rubber 2 having a two-layer structure was measured from the both sides thereof.

The impact resilience coefficient of the urethane rubbers was measured by using a resilience tester No. 221 manufactured by Toyo Seiki Seisakusho, Ltd., and a method described in JIS K6255. When measuring the impact resilience coefficient of each of the rubbers (which have a thickness of 2 mm), two or more pieces of the rubber were overlapped so that the rubber has a thickness of not less than 4 mm.

(Materials Used for Impregnation Treatment and Outermost Layer)

The following curable materials 1-11 were used for the impregnation treatment and for forming the outermost layer.

| (Curable material 1) | |
|---|---|
| Ultraviolet crosslinkable resin 1 (V-3F from Osaka Organic Chemical Industry Ltd., molecular weight of 154) | 10 parts by weight |
| Ultraviolet crosslinkable resin 2 (A-DCP from Shin-Nakamura Chemical Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 2) | |
|---|---|
| Ultraviolet crosslinkable resin 1 (V-3FM from Osaka Organic Chemical Industry Ltd., molecular weight of 168) | 10 parts by weight |
| Ultraviolet crosslinkable resin 2 (X-A-201 from Idemitsu Kosan Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 3) | |
|---|---|
| Ultraviolet crosslinkable resin 1 (V-4F from Osaka Organic Chemical Industry Ltd., molecular weight of 186) | 10 parts by weight |
| Ultraviolet crosslinkable resin 2 (X-A-201 from Idemitsu Kosan Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 4) | |
|---|---|
| Ultraviolet crosslinkable resin 1 (V-8F from Osaka Organic Chemical Industry Ltd., molecular weight of 286) | 10 parts by weight |
| Ultraviolet crosslinkable resin 2 (A-DCP from Shin-Nakamura Chemical Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 5) | |
|---|---|
| Ultraviolet crosslinkable resin 1 (V-8FM from Osaka Organic Chemical Industry Ltd., molecular weight of 300) | 10 parts by weight |
| Ultraviolet crosslinkable resin 2 (A-DCP from Shin-Nakamura Chemical Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 6) | |
|---|---|
| Ultraviolet crosslinkable resin 1 (V-3F from Osaka Organic Chemical Industry Ltd., molecular weight of 154) | 10 parts by weight |
| Ultraviolet crosslinkable resin 2 (PETIA from DAICEL-CYTEC Co., Ltd., molecular weight of 298) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

-continued

| (Curable material 7) | |
|---|---|
| Ultraviolet crosslinkable resin 1 (OP-TOOL from Daikin Co., Ltd., molecular weight of a few thousand) | 10 parts by weight |
| Ultraviolet crosslinkable resin 2 (A-DCP from Shin-Nakamura Chemical Co., Ltd., molecular weight of 304) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 8) | |
|---|---|
| Ultraviolet crosslinkable resin 1 (X-F-203 from Idemitsu Kosan Co., Ltd., molecular weight of 556) | 50 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 9) | |
|---|---|
| Ultraviolet crosslinkable resin 1 (OP-TOOL from Daikin Co., Ltd., molecular weight of a few thousand) | 10 parts by weight |
| Ultraviolet crosslinkable resin 2 (PETIA from DAICEL-CYTEC Co., Ltd., molecular weight of 298) | 40 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 10) | |
|---|---|
| Ultraviolet crosslinkable resin 1 (A-DOG from Shin-Nakamura Chemical Co., Ltd., molecular weight of 326) | 50 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

| (Curable material 11) | |
|---|---|
| Ultraviolet crosslinkable resin 1 (TMPEOTA from DAICEL-CYTEC Co., Ltd., molecular weight of 754) | 50 parts by weight |
| Polymerization initiator (1-hydroxycyclohexyl phenyl ketone, IRGACURE 184 from Ciba Specialty Chemicals (Ciba Japan K.K.)) | 5 parts by weight |
| Solvent (cyclohexanone) | 45 parts by weight |

Among the above-mentioned ultraviolet crosslinking resins, each of V-3F, V-3FM, V-4F, V-8F, V-8FM and OP-TOOL is a (meth)acrylate including a fluorine-containing group. A-DCP is an acrylate having a tricyclodecane skeleton, and X-A-201 is an acrylate having an adamantane skeleton. X-F-203 is an acrylate including a fluorine-containing group while having an adamantane skeleton. PETIA is an acrylate which has a pentaerythritol triacrylate skeleton as a main skeleton and which has a functional equivalent molecular weight of not greater than 350 and 3 to 6 functional groups. TMPEOTA is trimethylolpropane ethoxy triacrylate, and A-DOG is 1,10-decanediol diacryalte.

Next, the image forming apparatus used for the verification experiment will be described.

Preparation of Cleaning Blades of Examples 1-7 and Comparative Examples 1-7

Initially, strip-shaped elastic blades each having a thickness of 1.8 mm were prepared using the above-mentioned urethane rubber 1 or 2. The strip-shaped elastic blade was dipped into one of the curable materials 1-11 prepared above, followed by curing to prepare a crosslinked structure in the elastic blade. In this regard, after the elastic blade is dipped into the curable material for any period of time, the elastic blade was dipped into a solvent for washing the surface of the elastic blade for a short period of time, and the solvent remaining on the surface of the elastic blade was wiped with a sponge. After the elastic blade was dried for 3 minutes, the elastic blade was exposed to ultraviolet rays. In this regard, the power of the light source was 140 W/cm, and irradiation was performed 5 times (i.e., 5 passes) at a speed of 5 m/min. Further, the elastic blade was heated for 15 minutes at 100° C. using a heated-air drier. Thus, elastic blades for the below-mentioned cleaning blades of Examples 1-7 and Comparative Examples 1-7 were prepared. The details of the elastic blades are described in Tables 1 and 2 below.

In Example 6, the procedure for preparation of the elastic blade in Example 1 was repeated except that the dipping time (impregnation time) was shortened. In Example 7, the procedure for preparation of the elastic blade in Example 2 was repeated except that the dipping time (impregnation time) was shortened. In Comparative Example 7, an outermost layer having a thickness of 0.70 μm was formed by spray coating on each of the tip surface 62*a* and the lower 62*b* of the elastic blade.

Each of the thus prepared elastic blades was fixed to a metal plate holder of a color multifunction peripheral IMAGIO MP C5001 manufactured by Ricoh Co., Ltd., which has a structure similar to that of the image forming apparatus illustrated in FIG. 1, using an adhesive to prepare cleaning blades of Examples 1-7 and Comparative Examples 1-7. Each of the cleaning blades was alternately set to the color multifunction peripheral to be evaluated. The linear pressure and the cleaning angle of each of the cleaning blades were set to predetermined pressure and angle by setting the cleaning blade in such a manner that the cleaning blade digs into the photoconductor by a predetermined amount (i.e., the cleaning blade is longer by a predetermined amount than the gap between the tip of the cleaning blade and the surface of the photoconductor), and the cleaning blade has a predetermined mounting angle.

A polymerization toner was used for the verification experiment. The physical properties of the toner are the following.

Circularity of toner particles (i.e., mother toner): 0.98

Average particle diameter of toner particles (i.e., mother toner): 4.9 μm

External additives used for 100 parts by weight of toner particles:

1.5 parts by weight of a silica with a relatively small particle diameter, H2000 from Clariant Japan K.K.;

0.5 parts by weight of a titania with a relatively small particle diameter, MY-150AI from Tayca Corp.; and 1.0 part by weight of a silica with a relatively large particle diameter, UFP-30H from Denki Kagaku Kogyo K.K.

In a first verification experiment (i.e., experiment for initial evaluation), 5,000 copies of an original having an A-4 size and an image area proportion of 5% were produced in such a manner as 3 prints per job, and in a second verification experiment (i.e., experiment for durability evaluation), 30,000 copies of the original were produced in such a manner as 3 prints per job. In this regard, the environmental condition was 21° C. and 65% RH, and the recording sheet was fed in such a manner that the feeding direction of the recording sheet is perpendicular to the longer side of the recording sheet.

(Evaluation Items)

After each of the first and second verification experiments was performed, 20 copies of an image having three vertical stripe images with a width of 43 mm were produced, and the following evaluation was performed.

1. Eversion of Tip Edge Portion of Cleaning Blade

The cleaning blade was set on a photosensitive layer formed on an ITO film of a glass plate while moved under the same conditions as those mentioned above, and the tip edge portion of the cleaning blade contacted with the glass plate was visually observed from the opposite side of the glass plate to determine whether or not the tip edge portion is everted.

2. Crack and/or peeling of outermost layer

After the verification experiments, the outermost layer was visually observed with a microscope VHX-100 from Keyence Corp. to determine whether the outermost layer is cracked and/or peeled.

3. Thickness of Fluorine-Containing Portion (Impregnated Portion) in Units of μm Before the verification experiments, the cleaning blade was analyzed by a time-of-flight secondary ion mass spectrometer (TOF-SIMS), TRIFT III from ULVAC-PHI Inc., under the following conditions.

Primary ion: gallium (acceleration voltage of 15 kV)

Measurement area: 300 μm square

Polarity of secondary ion: positive and negative

4. Abrasion Loss of Blade in Units of μm

Figure 7:
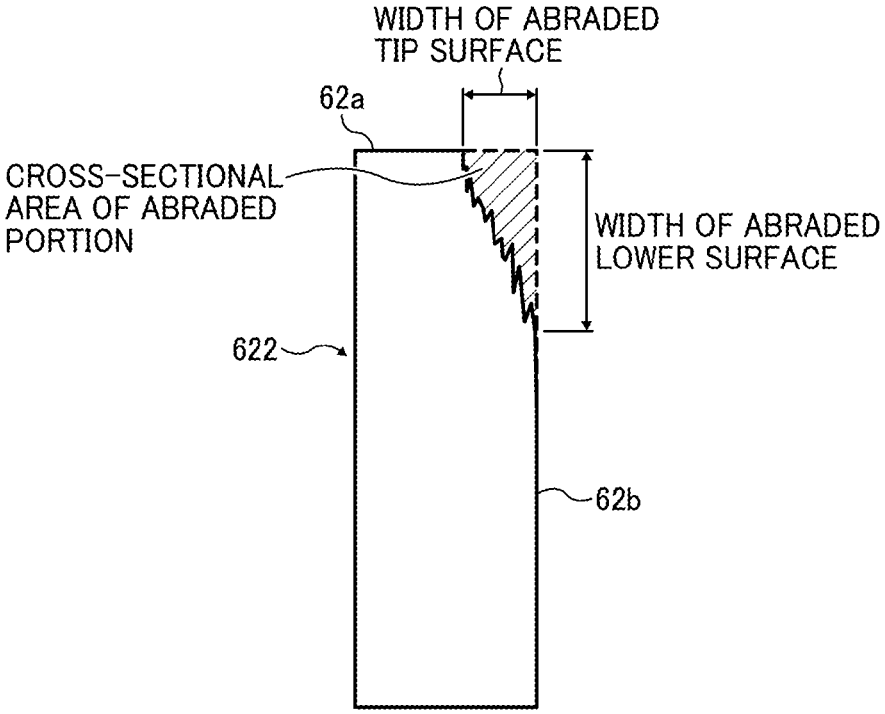
FIG. 7 is a schematic view illustrating a cleaning blade whose tip edge is abraded.
Figure 8A:
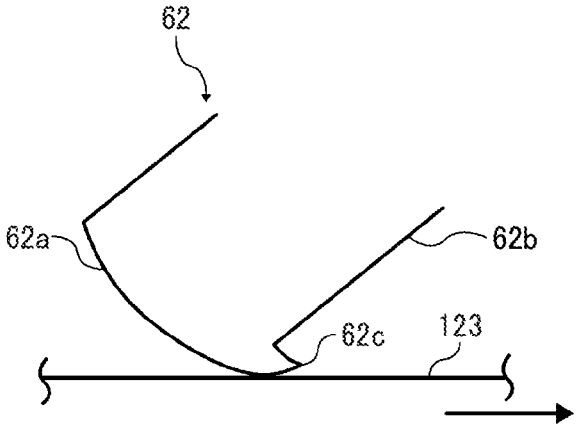
FIG. 8A RELATED ART
FIG. 8A is a schematic view illustrating a conventional cleaning blade whose tip edge is everted.
Figure 8B:
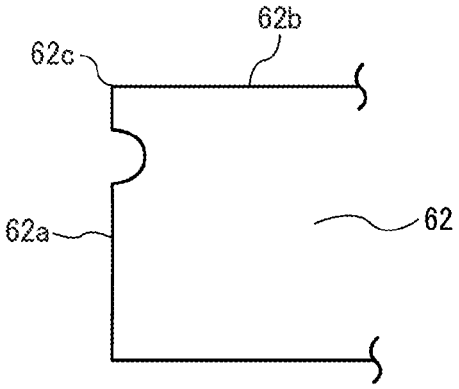
FIG. 8B RELATED ART
FIG. 8B is a schematic view illustrating the conventional cleaning blade whose tip portion is locally abraded.
Figure 8C:
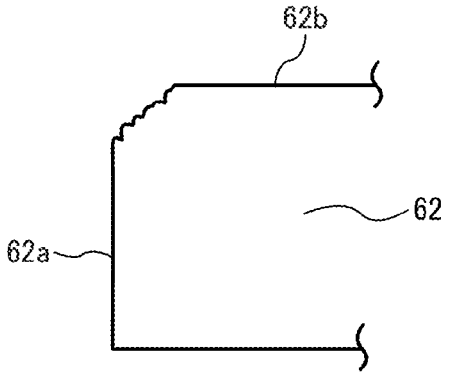
FIG. 8C RELATED ART
FIG. 8C is a schematic view illustrating the conventional cleaning blade whose tip edge is worn out.

After the verification experiments, the width of the abraded lower surface 62*b* (illustrated in FIG. 7) was measured using a laser microscope VK-9500 from Keyence Corp.

5. Abrasion Speed of Photoconductor in Units of μm/Km

The abrasion loss of the photoconductor was measured with the laser microscope VK-9500 from Keyence Corp., and the abrasion speed of the photoconductor was calculated from the abrasion loss and the travel distance of the photoconductor.

6. Filming

The surface of the photoconductor was visually observed by the microscope VHX-100 from Keyence Corp. to determine whether a film is formed on the surface of the photoconductor.

The results of the first verification experiment (initial evaluation) are shown in Table 1, and the results of the second verification experiment (durability evaluation) are shown in Table 2.

TABLE 1

| | No. of curable Material used | No. of curable material used for outer-most layer | Urethane rubber used | Thickness of fluorine-containing portion (μm) | Eversion of tip edge portion | Crack or peeling of outer-most layer | Abrasion loss of blade (μm) | Abrasion speed of photo-conductor (μm) | Filming |
|---|---|---|---|---|---|---|---|---|---|
| Ex. 1 | 1 | — | 1 | 300 | No | — | 1 | 0.1 | No |
| Ex. 2 | 2 | — | 1 | 250 | No | — | 1 | 0.1 | No |
| Ex. 3 | 3 | — | 1 | 250 | No | — | 1 | 0.15 | No |
| Ex. 4 | 4 | — | 1 | 200 | No | — | 1 | 0.15 | No |
| Ex. 5 | 5 | — | 2 | 200 | No | — | 1 | 0.1 | No |
| Ex. 6 | 1 | — | 1 | 5 | No | — | 1 | 0.1 | No |
| Ex. 7 | 2 | — | 1 | 10 | No | — | 1 | 0.1 | No |
| Comp. Ex. 1 | 6 | — | 1 | 300 | No | — | 4 | 0.1 | No |
| Comp. Ex. 2 | 7 | — | 2 | 2 | No | — | 1 | 0.15 | No |
| Comp. Ex. 3 | 8 | — | 1 | 3 | No | — | 2 | 0.1 | No |
| Comp. Ex. 4 | 9 | — | 1 | 2 | No | — | 1 | 0.15 | No |
| Comp. Ex. 5 | 10 | — | 1 | — | Yes | — | 3 | 0.4 | Yes |
| Comp. Ex. 6 | 11 | — | 1 | — | Yes | — | 3 | 0.4 | Yes |
| Comp. Ex. 7 | 9 | 9 | 1 | 2 | Yes | Yes | — | 0.4 | No |

TABLE 2

| | No. of curable Material used | No. of curable material used for outer-most layer | Urethane rubber used | Thickness of fluorine-containing portion (μm) | Evertsion of tip edge portion | Crack or peeling of outer-most layer | Abrasion loss of blade (μm) | Abrasion speed of photo-conductor (μm) | Filming |
|---|---|---|---|---|---|---|---|---|---|
| Ex. 1 | 1 | — | 1 | 300 | No | — | 2 | 0.1 | No |
| Ex. 2 | 2 | — | 1 | 250 | No | — | 2 | 0.1 | No |
| Ex. 3 | 3 | — | 1 | 250 | No | — | 2 | 0.15 | No |
| Ex. 4 | 4 | — | 1 | 200 | No | — | 2 | 0.17 | No |
| Ex. 5 | 5 | — | 2 | 200 | No | — | 2 | 0.13 | No |
| Ex. 6 | 1 | — | 1 | 5 | No | — | 2 | 0.1 | No |
| Ex. 7 | 2 | — | 1 | 10 | No | — | 2 | 0.1 | No |
| Comp. Ex. 1 | 6 | — | 1 | 300 | No | — | 9 | 0.2 | No |
| Comp. Ex. 2 | 7 | — | 2 | 2 | Yes | — | 4 | 0.8 | Yes |
| Comp. Ex. 3 | 8 | — | 1 | 3 | Yes | — | 5 | 0.9 | Yes |
| Comp. Ex. 4 | 9 | — | 1 | 2 | Yes | — | 5 | 0.8 | Yes |
| Comp. Ex. 5 | 10 | — | 1 | — | Yes | — | 4 | 0.8 | Yes |
| Comp. Ex. 6 | 11 | — | 1 | — | Yes | — | 8 | 0.9 | Yes |
| Comp. Ex. 7 | 9 | 9 | 1 | 2 | Yes | Yes | — | 0.9 | Yes |

The depth of the impregnated portion of each of the cleaning blades of Examples 1-7 and Comparative Example 2 was measured using a microhardness tester HM-2000 from Fischer Instruments K.K. As mentioned above, the hardness of the cross-section of the surface portion of the tip portion of the cleaning blade is measured with the microhardness tester before and after the impregnation treatment to determine whether the hardness of the surface portion increases. In this regard, the portion whose the hardness is increased is considered to be the impregnated portion, and the thickness of the portion is considered to be the depth of the impregnated portion.

The results are shown in Table 3.

TABLE 3

| | Depth of impregnated portion (μm) |
|---|---|
| Example 1 | 300 |
| Example 2 | 250 |
| Example 3 | 250 |
| Example 4 | 300 |
| Example 5 | 300 |
| Example 6 | 5 |
| Example 7 | 10 |
| Comparative Example 2 | 300 |

It is clear from Tables 1 and 2 that the cleaning blade of Comparative Example 7 causes a problem in that the outermost layer is cracked and peeled. In addition, since the curable material used for the impregnation treatment does not include an ultraviolet crosslinkable (meth)acrylic monomer having a fluorine-containing group in Comparative Examples 5 and 6, the lubricating effect of fluorine cannot be produced, thereby causing problems in that even in the initial evaluation, the cleaning blade is abraded, the abrasion speed of the photoconductor is relatively fast, and a film is formed on the surface of the photoconductor.

The cleaning blades of Comparative Examples 2 to 4 do not cause the above-mentioned problems, which the cleaning blades of Comparative Examples 5 and 6 cause, in the initial evaluation. However, it is clear from Table 2 that in the durability evaluation, the cleaning blades of Comparative Examples 2 to 4 cause the problems. This is because the curable material used for the impregnation treatment includes a (meth)acrylic monomer having a fluorine-containing group, which has a molecular weight of greater than 500, and therefore the depth of the impregnated portion is less than 5 μm, resulting in loss of fluorine after the cleaning blade is abraded after repeated use. As a result, the lubricating effect of fluorine cannot be produced, and therefore the cleaning blades of Comparative Examples 2 to 4 also cause the above-mentioned problems.

The abrasion loss of the cleaning blade of Comparative Example 1 is large even in the initial evaluation. The reason therefor is considered as follows. Specifically, since the (meth)acrylic monomer having a fluorine-containing group deeply penetrates into the elastic blade together with the other (meth)acrylic monomer, the crosslinkage density of the elastic blade increases from the surface to the deep portion thereof. As a result, the elasticity of the tip edge portion of the elastic blade seriously decreases (i.e., the elastic blade achieves a state similar to glass), and thereby movement of the tip edge portion is inhibited, resulting in deterioration of the abrasion resistance of the cleaning blade.

In contrast, since the thickness of the fluorine-containing portion of the cleaning blades of Examples 1-7 is not less than 5 μm, the lubricating effect of fluorine can be maintained over a long period of time. Therefore, even when the cleaning blades are used for an image forming apparatus having no lubricant applicator, occurrence of the above-mentioned problems (i.e., abrasion of the cleaning blade, acceleration of abrasion speed of the photoconductor, and filming problem) can be prevented. In addition, since a (meth)acrylate monomer having a fluorine-containing group, which has a molecular weight of not greater than 500 is used for the impregnation treatment, the thickness of the portion impregnated with the (meth)acrylate monomer can be increased so as to be not less than 5 μm. Further, since a (meth)acrylate having a tricyclodecane or adamantane skeleton is also used for the impregnation treatment, both the hardness and elasticity of the tip edge portion of the cleaning blades can be enhanced. Therefore, even when the (meth)acrylate monomer having a fluorine-containing group and the other (meth)acrylate are penetrated into a deep portion of the elastic blades, movement of the tip edge portion 62*c* of the cleaning blades cannot be inhibited, thereby preventing deterioration of the abrasion resistance of the cleaning blades.

Hereinbefore, several examples of the cleaning blade, the image forming apparatus and the process cartridge of this disclosure have been described. However, the cleaning blade, the image forming apparatus and the process cartridge of this disclosure are not limited thereto, and includes the following embodiments, which produce the below-mentioned specific effects.

Embodiment 1

A cleaning blade 62 of Embodiment 1 includes a strip-shaped elastic blade 622, wherein the tip edge portion 62*c* of the elastic blade 622 is to be contacted with the surface of a moving object such as a photoconductor 2 to remove a powdery material from the surface of the moving object. The tip edge portion 62 is impregnated with an ultraviolet curable material including an acrylate or methacrylate including a fluorine-containing group and another acrylate or methacrylate having a tricyclodecane or adamantane skeleton so that the depth of the impregnated portion is not less than 5 μm, followed by curing the curable material. Namely, the tip edge portion 62*c* includes an ultraviolet crosslinked resin, which includes an acrylate or methacrylate unit including a fluorine-containing group, and another acrylate or methacrylate unit having a tricyclodecane or adamantane skeleton, from the surface of the tip edge portion 62*c* to a depth of not less than 5 μm.

In the cleaning blade 62 of Embodiment 1, the tip portion 62*d* thereof is impregnated with an ultraviolet curable material including an acrylate or methacrylate including a fluorine-containing group and another acrylate or methacrylate having a tricyclodecane or adamantane skeleton so that the depth of the impregnated portion is not less than 5 μm, followed by curing the material, abrasion of the cleaning blade and the image bearer (such as photoconductor) can be avoided over a long period of time even when the cleaning blade 62 is used for image forming apparatus having no lubricant applicator, resulting in prolongation of the lives of the cleaning blade and the photoconductor, as mentioned above in the verification experiment. In addition, since the lubricating effect of fluorine can be maintained over a long period of time, occurrence of the filming problem can be prevented even when the cleaning blade is used for image forming apparatus having no lubricant applicator.

This is because the depth of the portion impregnated with the acrylate or methacrylate including a fluorine-containing group is not less than 5 μm, and therefore the lubricating effect of fluorine can be maintained even when the cleaning blade is abraded after long repeated use, thereby making it possible to prevent serious abrasion of the cleaning blade. In a case of a cleaning blade having an outermost layer, even when the outermost layer is abraded and the elastic blade is revealed, the lubricating effect of fluorine can be maintained, thereby making it possible to prolong the life of the cleaning blade while preventing occurrence of the filming problem. Even when the cleaning blade has no outermost layer, the lubricating effect of fluorine can be maintained over a long period of time, and therefore the life of the cleaning blade can be prolonged. Therefore, it is possible for the cleaning blade to have no outermost layer. In this case, occurrence of a problem in that the outermost layer is cracked or peeled can be prevented. In addition, by using the cleaning blade, it is not necessary for the image forming apparatus to have a lubricant applicator, thereby making it possible to downsize the image forming apparatus.

As mentioned above in the "Description of the Related Art" section, a cleaning blade is proposed in which a mixture of a fluorine-containing acrylic monomer, an acrylate material including as a main skeleton a pentaerythritol triacrylate and having a functional group equivalent molecular weight (i.e., molecular weight of a compound per one functional group) of not greater than 350 and 3 to 6 functional groups, and another acrylate material having a functional group equivalent molecular weight of from 100 to 1,000 and 1 to 2 functional groups is used for forming the ultraviolet crosslinked resin, which hardens the tip edge portion of the cleaning blade. However, as mentioned above by reference to Comparative Example 1 in the verification experiment, when the elastic blade is impregnated with a (meth)acrylate having a fluorine-containing group to a deep portion thereof, the elasticity of the elastic blade seriously deteriorates, and the elastic blade becomes more like glass than rubber. Therefore, movement of the tip edge portion of the cleaning blade is inhibited, thereby deteriorating the abrasion resistance of the cleaning blade.

In contrast, in the cleaning blade of Embodiment 1, a (meth)acrylate having a tricyclodecane or adamantane skeleton is used for the ultraviolet curable material to enhance the hardness of the tip edge portion of the cleaning blade. This material can enhance not only hardness but also elasticity of the cleaning blade. Therefore, as described above by reference to Examples 1-7 in the verification experiment, the tip edge portion 62*c* can maintain proper elasticity even when the elastic blade is deeply impregnated with the (meth)acrylate having a fluorine-containing group, thereby making it possible to reduce abrasion loss of the cleaning blade.

Embodiment 2

The cleaning blade of Embodiment 2 has a configuration such that in addition to the configuration of the cleaning blade of Embodiment 1 mentioned above, the thickness (depth) of the surface portion of the elastic blade impregnated with the (meth)acrylate having a fluorine-containing group and the (meth)acrylate having a tricyclodecane or adamantane skeleton is not greater than 300 μm.

In the cleaning blade of Embodiment 2, since the thickness of the surface portion of the elastic blade impregnated with the (meth)acrylate having a fluorine-containing group and the (meth)acrylate having a tricyclodecane or adamantane skeleton is not greater than 300 μm, the cleaning blade can maintain good cleanability over a long period of time by preventing abrasion of the cleaning blade and the image bearer for which the cleaning blade is used, as mentioned above by reference to Examples 1-7 in the verification experiment.

Embodiment 3

The cleaning blade of Embodiment 3 has a configuration such that in addition to the configuration of the cleaning blade of Embodiment 1 or 2 mentioned above, the (meth)acrylate having a fluorine-containing group has a molecular weight of not greater than 500.

In the cleaning blade of Embodiment 3, as mentioned above, the (meth)acrylate having a fluorine-containing group can be rapidly penetrated into the elastic blade in the impregnation treatment so that the depth of the impregnated portion is not less than 5μm, thereby enhancing the manufacturing efficiency of the cleaning blade.

Embodiment 4

The cleaning blade of Embodiment 4 has a configuration such that in addition to the configuration of the cleaning blade of any one of Embodiments 1, 2 and 3 mentioned above, the ultraviolet curable material further includes a monomer including a pentaerythritol triacrylate skeleton and having a functional group equivalent molecular weight of not greater than 350 and 3 to 6 functional groups.

In the cleaning blade of Embodiment 4, as mentioned above, the hardness of the tip portion of the elastic blade can be further enhanced, thereby making it possible to prevent the tip portion from being seriously deformed, resulting prevention of occurrence of eversion of the tip portion of the cleaning blade.

Embodiment 5

The cleaning blade of Embodiment 5 has a configuration such that in addition to the configuration of the cleaning blade of any one of Embodiments 1 to 4 mentioned above, the elastic blade includes two or more strip-shaped rubbers, which are overlaid and which have different JIS-A hardness.

In the cleaning blade of Embodiment 5, the hardness of the rubber to be contacted with the moving object is greater than that of the rubber on the opposite side so that deformation of the tip edge portion of the cleaning blade can be prevented, thereby making it possible for the elastic blade to maintain good flexibility.

Embodiment 6

An image forming apparatus of Embodiment 6 includes a rotatable image bearer to bear a visible image thereon, a transferring device to transfer the visible image to a recording medium optionally via an intermediate transfer medium, and a cleaner including any one of the cleaning blades of Embodiments 1-5 to clean the surface of the image bearer after the visible image on the surface of the image bearer is transferred to the recording medium or the intermediate transfer medium.

Since the image forming apparatus has such a configuration, the image forming apparatus can produce high quality images over a long period of time while having a long maintenance cycle.

Embodiment 7

A process cartridge of Embodiment 7 includes a rotatable image bearer to bear a visible image thereon, and a cleaner including any one of the cleaning blades of Embodiments 1-5 to clean the surface of the image bearer after the visible image on the surface of the image bearer is transferred to a recording medium or an intermediate transfer medium. The process cartridge is detachably attachable to an image forming apparatus as a single unit.

Since the process cartridge has such a configuration, the process cartridge can produce high quality images over a long period of time while having a long maintenance cycle.

As mentioned above, the cleaning blade of this disclosure can reduce abrasion loss of the cleaning blade and an image bearer with which the cleaning blade is contacted even when the cleaning blade has no outermost layer while preventing occurrence of the filming problem even when used for an image forming apparatus which does not apply a lubricant to the surface of the image bearer.

Additional modifications and variations of the present invention are possible in light of the above teachings. It is therefore to be understood that within the scope of the appended claims the invention may be practiced other than as specifically described herein.

What is claimed is:

1. A cleaning blade comprising:

a strip-shaped elastic blade, wherein at least a tip edge portion of the elastic blade, which is to be contacted with a surface of a moving object to remove a powdery material from the surface of the moving object, includes an ultraviolet crosslinked resin, which includes an acrylate or methacrylate unit including a fluorine-containing group, and another acrylate or methacrylate unit having a tricyclodecane or adamantane skeleton, from a surface of the tip edge portion to a depth of not less than 5 μm.

2. The cleaning blade according to claim 1, wherein the tip edge portion of the elastic blade includes the ultraviolet crosslinked resin from the surface of the tip edge portion to a depth of not greater than 300 μm.

3. The cleaning blade according to claim 1, wherein the acrylate or methacrylate having a fluorine-containing group has a molecular weight of not greater than 500.

4. The cleaning blade according to claim 1, wherein the ultraviolet crosslinked resin further includes a unit of a monomer having a pentaerythritol triacrylate skeleton while having a functional group equivalent molecular weight of not greater than 350 and 3 to 6 functional groups.

5. The cleaning blade according to claim 1, wherein the elastic blade includes two or more rubber strips, which are overlaid and which have different JIS-A hardness.

6. An image forming apparatus comprising:

a rotatable image bearer to bear a visible image on a surface thereof;

a transferring device to transfer the visible image to a recording medium optionally via an intermediate transfer medium; and a cleaner including the cleaning blade according to claim 1 to clean the surface of the image bearer after the visible image is transferred to the recording medium or the intermediate transfer medium by contacting the tip edge portion of the elastic blade with the surface of the image bearer.

7. A process cartridge comprising:

a rotatable image bearer to bear a visible image on a surface thereof; and a cleaner including the cleaning blade according to claim 1 to clean the surface of the image bearer by contacting the tip edge portion of the elastic blade with the surface of the image bearer.

8. A method for preparing the cleaning blade according to claim 1, comprising:

impregnating a tip portion of a strip-shaped elastic rubber plate with a curable material including an acrylate or methacrylate having a fluorine-containing group, and another acrylate or methacrylate having a tricyclodecane or adamantane skeleton from a surface of the tip portion to a depth of not less than 5 μm, wherein the tip portion includes at least a tip edge portion of the elastic rubber plate; and curing the curable material with ultraviolet rays to prepare the cleaning blade.

* * * * *